US005677698A

United States Patent [19]

Snowdon

[11] Patent Number: 5,677,698

[45] Date of Patent: Oct. 14, 1997

[54] SLOT ANTENNA ARRANGEMENT FOR PORTABLE PERSONAL COMPUTERS

[75] Inventor: Robert Alan Snowdon, Lydbrook, United Kingdom

[73] Assignee: Plessey Semiconductors Limited, United Kingdom

[21] Appl. No.: 511,543

[22] Filed: Aug. 4, 1995

[30] Foreign Application Priority Data

Aug. 18, 1994 [GB] United Kingdom ..... 9416730

[51] Int. Cl.[6] ..... H01Q 13/10

[52] U.S. Cl. ..... 343/770; 343/767; 343/702

[58] Field of Search ..... 343/702, 700 MS, 343/725, 767, 846, 770

[56] References Cited

U.S. PATENT DOCUMENTS

| | | | |
|---|---|---|---|
| 4,443,802 | 4/1984 | Mayes | 343/767 |
| 4,694,301 | 9/1987 | Wassum | 343/720 |
| 4,935,745 | 6/1990 | Mori et al. | 343/767 |
| 4,975,711 | 12/1990 | Lee | 343/767 |
| 4,980,694 | 12/1990 | Hines | 343/702 |
| 5,138,328 | 8/1992 | Zibrik et al. | 343/782 |
| 5,373,300 | 12/1994 | Tenness et al. | 343/702 |
| 5,394,160 | 2/1995 | Iwasaki et al. | 343/702 |
| 5,404,583 | 4/1995 | Lalezari et al. | 343/702 |
| 5,467,477 | 11/1995 | Furuta et al. | 343/702 |

FOREIGN PATENT DOCUMENTS

| | | |
|---|---|---|
| 0 117 990 A1 | 9/1984 | European Pat. Off. . |
| 0 508 567 A2 | 10/1992 | European Pat. Off. . |
| 0 543 645 A1 | 5/1993 | European Pat. Off. . |
| 0 571 124 A1 | 11/1993 | European Pat. Off. . |

*Primary Examiner*—Donald T. Hajec
*Assistant Examiner*—Tan Ho
*Attorney, Agent, or Firm*—Kirchstein, et al.

[57] ABSTRACT

An antenna arrangement is provided in which a slot antenna is attached to the surface of an equipment case made of a dielectric material, there being provided also a ground plane spaced a small distance apart from the case and behind the antenna. The equipment may be a personal computer, e.g. a notebook computer, and the antenna, which may take the form of a copper foil, may be attached to the lid of the computer by an adhesive on its rear surface. The ground plane may, in this case, take the form of an existing display backplane. The invention provides for the realization of a compact antenna arrangement due to the effect of the case dielectric on the effective electrical length of the slot antenna.

6 Claims, 2 Drawing Sheets

SLOT ANTENNA ARRANGEMENT FOR PORTABLE PERSONAL COMPUTERS

BACKGROUND OF THE INVENTION

The invention concerns an antenna arrangement, and in particular, though not exclusively, an antenna arrangement suitable for use with portable electrical equipment.

There is a growing need for low-cost, simple and compact antennae for use with wireless local area network (WLAN) equipment operating at 1 to 3 GHz.

SUMMARY OF THE INVENTION

In accordance with a first aspect of the invention, there is provided an antenna arrangement for an electrical apparatus having a case composed of a dielectric material, the antenna arrangement comprising a portion of said case, a ground plane and a slot antenna element, the ground plane being in a spaced relationship to a surface of said case portion and the antenna element being located between the ground plane and said surface and attached to said surface.

The advantage of this arrangement is that the juxtaposition of the antenna element and the dielectric case surface results in an increase in the effective electrical length of the antenna, thereby enabling the physical length, and overall physical size, of the slot antenna to be reduced. This makes for greater compactness, especially in small, portable equipment in which the antenna arrangement may be used, and a decrease in material costs.

The ground plane may be spaced approximately one-sixtieth of a wavelength, according to a frequency of operation of the electrical apparatus, away from the slot antenna element. The spacing of the ground plane from the antenna element affects the antenna beam width, and, although it is not critical, it has been found that the above-specified spacing results in an acceptable beam width.

The antenna arrangement may comprise a connection means coupled to the slot antenna element at a point which gives rise to a minimum standing wave ratio. The connection means will usually be a length of 50Ω coaxial cable connected to opposite edges of the slot.

The case may be a case of a portable computer, said case portion may be a portion of a lid of the computer, said surface may be an inner surface of said lid and said ground plane may be a conductive rear surface of a display circuit board attached to said lid.

The antenna element may comprise a copper foil with a slot dimensioned to provide a quarter- or half-wavelength antenna. The copper foil may be equipped with an adhesive on one side for attachment to the surface of the case. This has the advantage that an existing computer or other piece of electrical equipment may be readily provided with an antenna by merely locating a suitable flat surface on the inside of a lid or other part of the equipment and pressing the adhesive-coated surface of the antenna foil down firmly onto that surface.

In accordance with a second aspect of the invention, there is provided an electrical apparatus comprising an antenna arrangement as described above. It is envisaged that the antenna arrangement of the invention will be used mainly in personal computers or so-called "personal digital assistants" in which space and compactness are of primary concern, thus the electrical apparatus may be a portable computer.

The electrical apparatus may comprise one or more further antenna arrangements to form a diversity configuration. Such a configuration is well known as a means of combatting the effects of multipath propagation common in a typical office environment, for example, in which many sources of reflection (e.g. walls, floors, filing cabinets) may be present.

BRIEF DESCRIPTION OF THE DRAWINGS

The invention will now be described, by way of example only, with reference to the drawings, of which.

DETAILED DESCRIPTION OF EMBODIMENTS OF THE INVENTION

Figure 1:
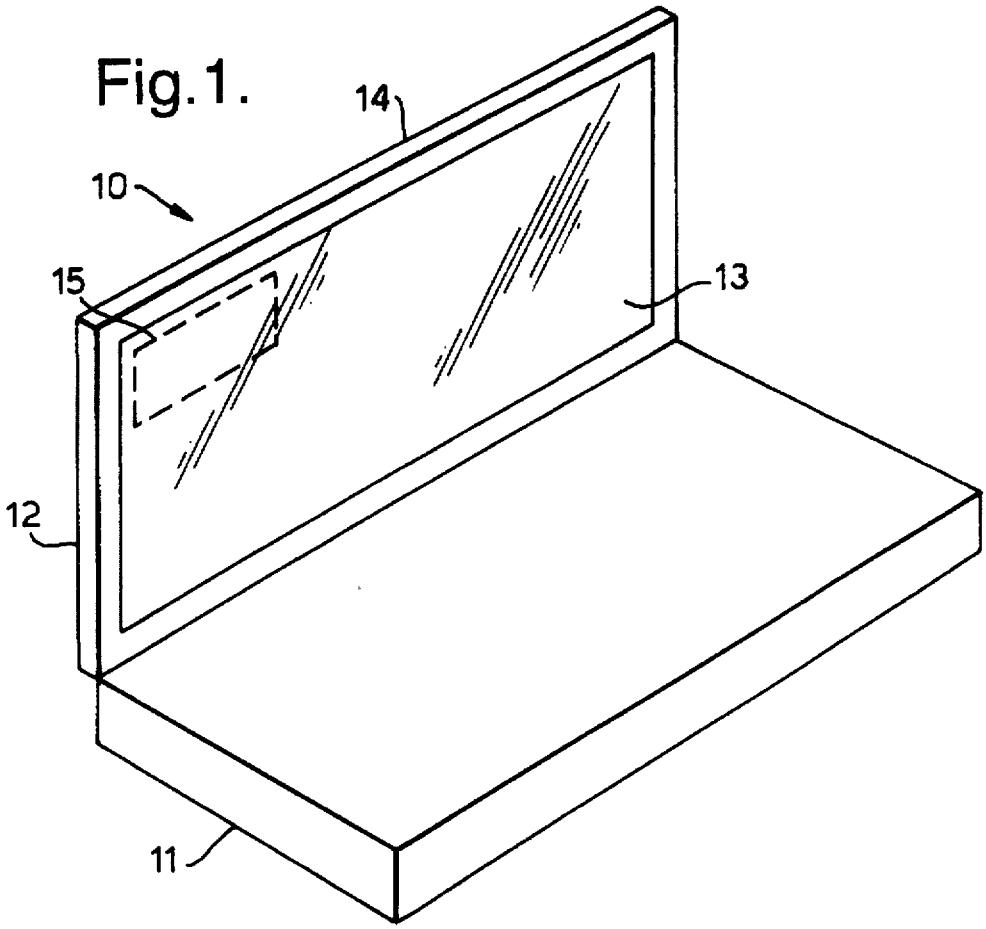
FIG. 1 is a general view of an electrical apparatus incorporating an antenna arrangement according to the invention.

Referring now to FIG. 1, an electrical apparatus in the form of a portable personal computer (a "notebook" computer) 10 is shown comprising a body portion 11 and a lid portion 12 containing a display 13, which may, for example, be a liquid crystal display (LCD) or a gas discharge display. The display itself is mounted on a backplane and is spaced apart from the inner major surface 14 of the lid potion 12. Attached to an area of the inner major surface 14 is a slot antenna element 15 shown dotted behind the display 13.

Figure 2:
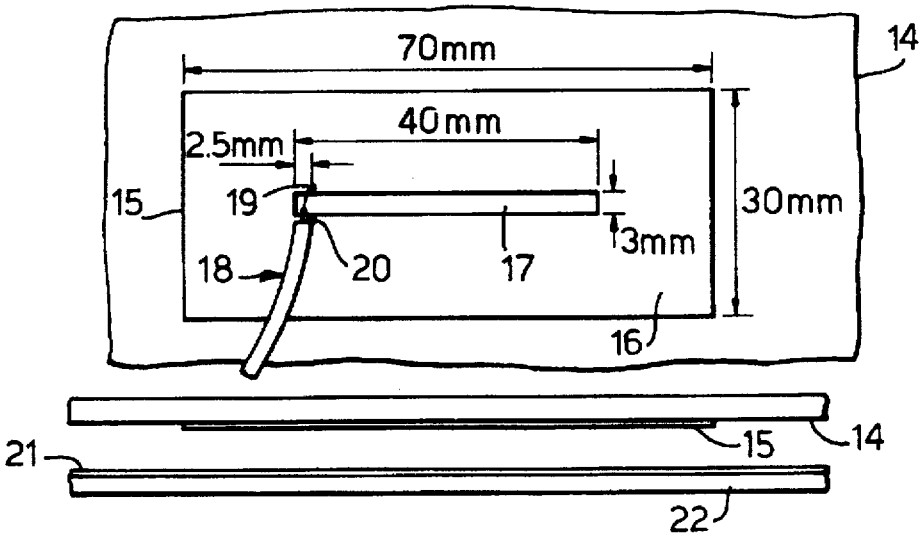
FIG. 2 is a detailed view of the antenna area of the electrical apparatus of FIG. 1.

A more detailed representation of the antenna arrangement is given in FIG. 2. In FIG. 2, the slot antenna element 15 is shown attached via an adhesive coating on its rear side to the inner surface 14 of the lid portion 12 of the computer. The antenna element 15 consists of a copper foil 16 of dimensions 70 mm×30 mm, in which is formed a rectangular, 40 mm×3 mm slot 17. The slot 17 acts as a half-wavelength antenna for operation at 2.54 GHz. The slot would without the provision of the case be roughly 60 mm long at that frequency, but because the dielectric case has the effect of increasing the effective length of the antenna, the slot is shortened to 40 mm, thereby providing a substantial saving in space and material costs.

The copper foil is arranged to be greater than five skin-effect depths in thickness. A thinner foil results in an increase in losses. The skin-effect depth is $6.62/\sqrt{f}$ cm, i.e. at 2.54 GHz, 12.65 μm. Thus the foil is made to be at least 35 μm thick at this particular frequency.

The slot is interfaced to the associated transmitting/receiving circuitry by a 50Ω coaxial cable connection 18. The inner core of the cable is soldered to the upper edge of the slot at a point 19 and the outer sheath to the lower edge at a point 20, the two points being chosen to provide at the same time as near a perfect 50Ω connection as possible and the lowest possible voltage standing wave ratio (VSWR).

Figure 3A:
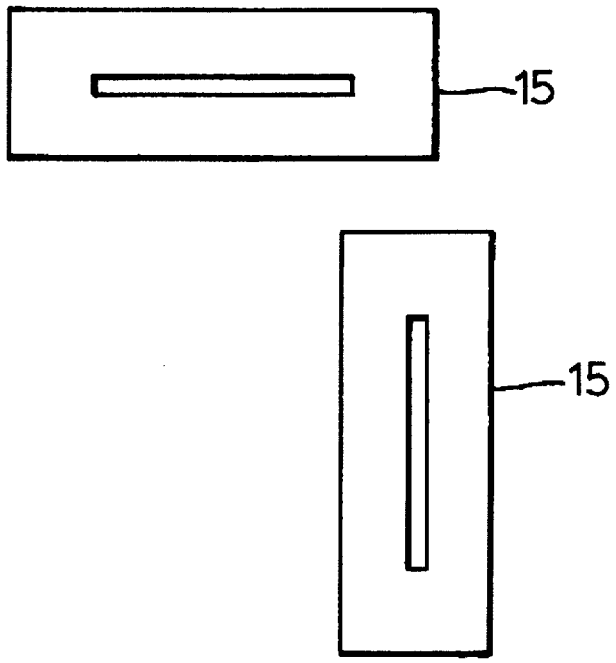
FIGS. 3*a* and 3*b* show two diversity arrangements which may be employed in the antenna arrangement according to the invention.
Figure 3B:
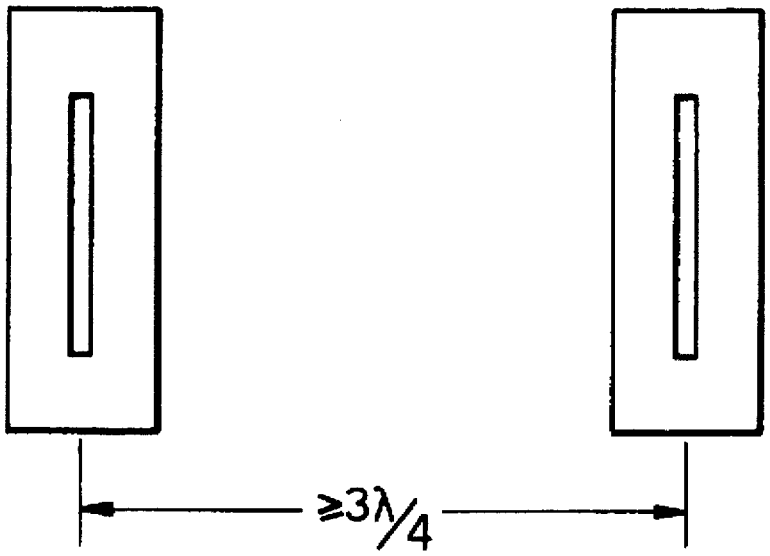

A ground plane is mounted in the lid portion 12 just behind the slot antenna element 15 and takes the form, here, of the ground plane 21 on the rear side of the printed circuit board 22 holding the computer display 13. Ideally, the ground plane 21 is arranged to be approximately 2 mm away from the antenna element 15 in order to provide an optimum beam width at a frequency of 2.54 GHz. However, this distance is not critical and in practical computer settings (the invention allows for the antenna element simply to be attached to the lid of an existing computer) this distance may well be greater or less than this. At all events, however, there must be a ground plane behind the antenna if the latter is to function correctly.

Where the invention is to be used in an environment in which multiple reflections are likely to be experienced (typically, an office-type environment, for example), it may be necessary to incorporate diversity into the antenna arrangement. FIG. 3(*a*) shows one such arrangement, in which two antenna elements are mounted close to each other at right angles. This system is acceptable where the size of the equipment in which the antenna is to be used is small, as in the case of a notebook computer. However, where more space is available, two such antenna elements could be mounted an odd number of quarter wavelengths apart. In order to minimise interaction between the antennas, the preferred distance between them is $\geqq 3\lambda/4$. This is shown in FIG. 3(*b*).

While the invention is conceived primarily for use with small, portable electrical equipment, the antenna arrangement described may also be employed in larger, stationary equipment. Clearly, the dimensions of the antenna element used will vary according to the frequency of operation and the dielectric properties of the case material employed. In practice, when it is known into what specific equipment the antenna arrangement is to be incorporated, an initial check of the properties of the case material is made, principally dielectric constant, and an initial calculation of antenna dimensions including the pick-off points 19 and 20 then carried out. Subsequently, in production, those dimensions, particularly the pick-off point, can be adjusted to give the best results in practice. Once the correct measurements have been arrived at, they should remain the same during an entire production run, provided the equipment manufacturer continues to use the same case (case thickness, dielectric constant, etc.). Even where the manufacturer decides to obtain the case from another source, the electrical differences between cases from different suppliers are unlikely to be great enough to cause significant problems in the performance of the antenna arrangement provided by the invention.

Also, where the antenna arrangement is to be used with electrical equipment in which a suitable ground plane is not already available, such as the display ground plane in the personal computer, such a plane must be specifically provided.

The antenna arrangement may be covered by a layer (not shown) of a composite material having a frequency selective surface comprising an array of metallic patches or slots which allow electromagnetic radiation to pass only at or near their resonant frequencies. By this means any spurious out-of-band emissions which may be generated by frequency-hopping spread spectrum signals generated by the WLAN transmitter may be reduced, and saturation of the receiver front-end circuits by out-of-band radio frequencies may be avoided.

I claim:

1. Electrical apparatus incorporating an antenna arrangement, the apparatus comprising:

a casing of dielectric material, said casing having an inner face;

a substantially planar sheet of electrically conductive material secured to the inner face of said casing, and having formed therein at least two elongate apertures defining respective slot antennas in a diversity configuration, said slot antennas being electrically coupled to the dielectric material of said casing;

a substantially planar ground plane means secured in spaced relationship with, and substantially parallel with, said sheet of electrically conductive material; and respective connection means coupled to at least one edge of each said elongate aperture.

2. The electrical apparatus in accordance with claim 1, wherein each said slot antenna is dimensioned for operation at a predetermined center frequency, and said ground plane means is spaced from said sheet of electrically conductive material by approximately one sixtieth of a wavelength at said predetermined center frequency.

3. The electrical apparatus in accordance with claim 2, wherein each said slot antenna is dimensioned as a half-wave antenna at said predetermined center frequency.

4. The electrical apparatus in accordance with claim 1, wherein said casing houses a portable computer, wherein said sheet of electrically conductive material is secured to an inner face of a lid portion of the casing, and wherein said ground plane means is formed by a conductive rear face of a display circuit board attached to said lid portion.

5. The electrical apparatus in accordance with claim 1, wherein said sheet of electrically conductive material comprises a copper foil.

6. The electrical apparatus in accordance with claim 1, wherein said sheet of electrically conductive material is secured to said inner face of said casing by means of an adhesive.

* * * * *